US006790313B1

(12) United States Patent
Sandquist et al.

(10) Patent No.: US 6,790,313 B1
(45) Date of Patent: Sep. 14, 2004

(54) METHOD OF CLEANING SULFIDE CONTAMINATED CONDENSATES

(75) Inventors: Kent K. Sandquist, Askim (SE); Olle Wennberg, Gothenburg (SE)

(73) Assignee: Excelentec Holding AB, Gothenburg (SE)

( * ) Notice: Subject to any disclaimer, the term of this patent is extended or adjusted under 35 U.S.C. 154(b) by 0 days.

(21) Appl. No.: 09/856,961

(22) PCT Filed: Nov. 24, 1999

(86) PCT No.: PCT/SE99/02170

§ 371 (c)(1),
(2), (4) Date: Nov. 9, 2001

(87) PCT Pub. No.: WO00/34569

PCT Pub. Date: Jun. 15, 2000

(30) Foreign Application Priority Data

Nov. 26, 1998 (SE) ..... 9804061

(51) Int. Cl.[7] ..... D21C 11/06

(52) U.S. Cl. ..... 162/15; 162/30.1; 162/30.11; 162/47; 159/47.3; 203/22; 203/27

(58) Field of Search ..... 162/17, 29, 14, 162/15, 16, 51, 30.1, 30.11, 47; 159/47.3; 203/22, 27, 98; 422/169

(56) References Cited

U.S. PATENT DOCUMENTS 5,450,892 A * 9/1995 Gautreaux, Jr. ..... 162/16
6,136,144 A * 10/2000 Martin et al. ..... 162/14
6,261,412 B1 * 7/2001 Ryham ..... 162/17

FOREIGN PATENT DOCUMENTS

| | | |
|---|---|---|
| GB | 1 354 499 | 5/1974 |
| WO | 86/00389 | 1/1986 |
| WO | 98/55685 | 12/1998 |

* cited by examiner

*Primary Examiner*—Steve Alvo
(74) *Attorney, Agent, or Firm*—Mitchell D. Bittman; Kevin S. Lemack

(57) ABSTRACT

A method to remove sulfides and other volatile contaminants from liquor vapor condensate in a pulp manufacturing process, where the mentioned liquor vapor condensate is fed into a stripper, which is part of a closed loop system including the stripper, a regenerative thermal oxidization process (RTO) and a $SO_2$ scrubber, in which loop a gas is circulated, preferably air, and such components formed or stripped off, in this loop whereafter the circulating gas is stripped off sulfides and other volatile components from the liquor vapor condensate, whereafter the gas stream is fed into a RTO process, where the stripped off contaminants are combusted are under formation of $SO_2$ and thereafter the $SO_2$ enriched gas is led to a $SO_2$ scrubber, where preferably alkali is used as absorption medium, and thereafter the circulating gas is returned back into the stripper.

10 Claims, 1 Drawing Sheet

METHOD OF CLEANING SULFIDE CONTAMINATED CONDENSATES

In producing chemical pulp according to the Kraft chemical pulp process, waste liquor is produced that is being evaporated prior to burning. During the evaporation process, liquor vapor is stripped off, which in addition to water vapor, also contains certain volatile contaminants. Such contaminants are hydrogen sulfide, methylmercaptan, dimethylsulfide, methanol, terpenes etc. At the evaporation which takes place as a so called multiple effect evaporation with a number of stages, effects (normally 4–7), the liquor vapor is also condensed in multiple stages, whereby also large amounts of the volatile contaminants will condense. The condensation takes place in at least as many stages there are effects. This means that the quality of the condensate varies significantly from the different stages of the evaporation. Normally 2–3 different condensate qualities are being separated, where each one is a mixture of condensates from a number of effects. The dirtiest condensate, (foul condensate), is normally treated in a steam stripper where the volatile components are flashed off. This foul condensate is typically a small amount of the total condensate flow and therefore the steam economy is not affected to any higher degree of the fact that steam is used as the stripper gas. The investment cost can also be kept at a minimum.

The purity of the other condensate qualities is highly dependent on the amount of foul condensate. If the amount of foul condensate is increased the contaminated condensates will be cleaner. A too high amount of foul condensate however the operating and investment cost for the steam stripper system will increase.

The other, less contaminated condensates can to a limited extent be used as process water in dependency of their cleanliness. However if the condensate is too contaminated it can not be re-used but must instead be discharged to the recipient subsequent to some form of treatment The primary limiting factor for the use of the contaminated condensate as process water is the content of sulfides, as these can give an unpleasant small and taste to the pulp. It also creates a significant problem for the working environment. Also terpenes give a smell. The terpenes however are normally present at very low amounts in the less contaminated condensates.

The technology available to clean these condensates is predominately steam stripping. Since the various condensate flows are very large, the size of the stripper will be significant and a large amount of steam will be required for stripping. The steam volumes will be so large that it will definitely not be economical to use fresh steam. On the other hand it is possible to use flash steam driven off from the evaporation of the waste liquor, in multiple effect evaporation for the stripping. The steam leaving the stripper then can be regained as heat in the next evaporation effect. The cleaning efficiency of such a stripper is however limited since the flash steam from the preceding effect is already contaminated with sulfides, which limits the degree of purity of the output condensate. Primarily the cleanliness is limited regarding sulphides, as the waste liquor can have a considerable content of sulphides. This sulphide content is dependent on that steam is normally taken from the first effect, where the temperature is rather high, which gives an increased sulphide content.

Another drawback is that when the steam passes through the stripper, it loses pressure and volatile components are enriched. These two things will reduce the condensation temperature, which means that the temperature difference available at the evaporation is reduced. The energy and capital cost are both negatively impacted thereby. Furthermore the evaporation plant and the stripper are completely integrated, whereby these two parts can not be independently operated.

The dimensions of the stripper also will become large, which means significant costs for the equipment.

In a conventional steam stripper also other volatile components, such as methanol, are stripped off.

Air can be used to in lieu of steam to strip the condensates. A big drawback with this method is that air is being contaminated and must be cleaned in some way. The air volumes can also be very large. Additionally the condensate is being cooled down by the air, which has a lower wet bulb temperature as compared to the temperature of the condensate. For these reasons pure air stripping is not a realistic alternative for a modern and environmentally friendly pulp mill.

The present invention provides a possibility to strip off primarily sulfides at a very high efficiency from liquor-steam condensates from a pulp manufacturing process, and simultaneously to take care of the sulphur, thus that it will not contaminate the environment. This is being done in a closed loop concept that is comprised of three process steps, where the sulfides are stripped off from the condensate, the stripped off sulfides are being oxidized to sulphur dioxide, and to absorb the sulphur dioxide formed.

The three process steps are consequently:

1. Stripping off sulphides from liquor-steam condensate
2. Oxidation of combustible components such as sulphides and hydro carbons.
3. Absorption of sulphur dioxide.

By integrating these three process steps (1, 2, and 3) in a closed loop cycle, the cleaning of condensates can be done with a high efficiency, good heat economy, and minimal impact on the environment

BRIEF DESCRIPTION OF THE DRAWING

The drawing schematically shows the various process steps in accordance with the invention.

DETAILED DESCRIPTION

Figure 1:
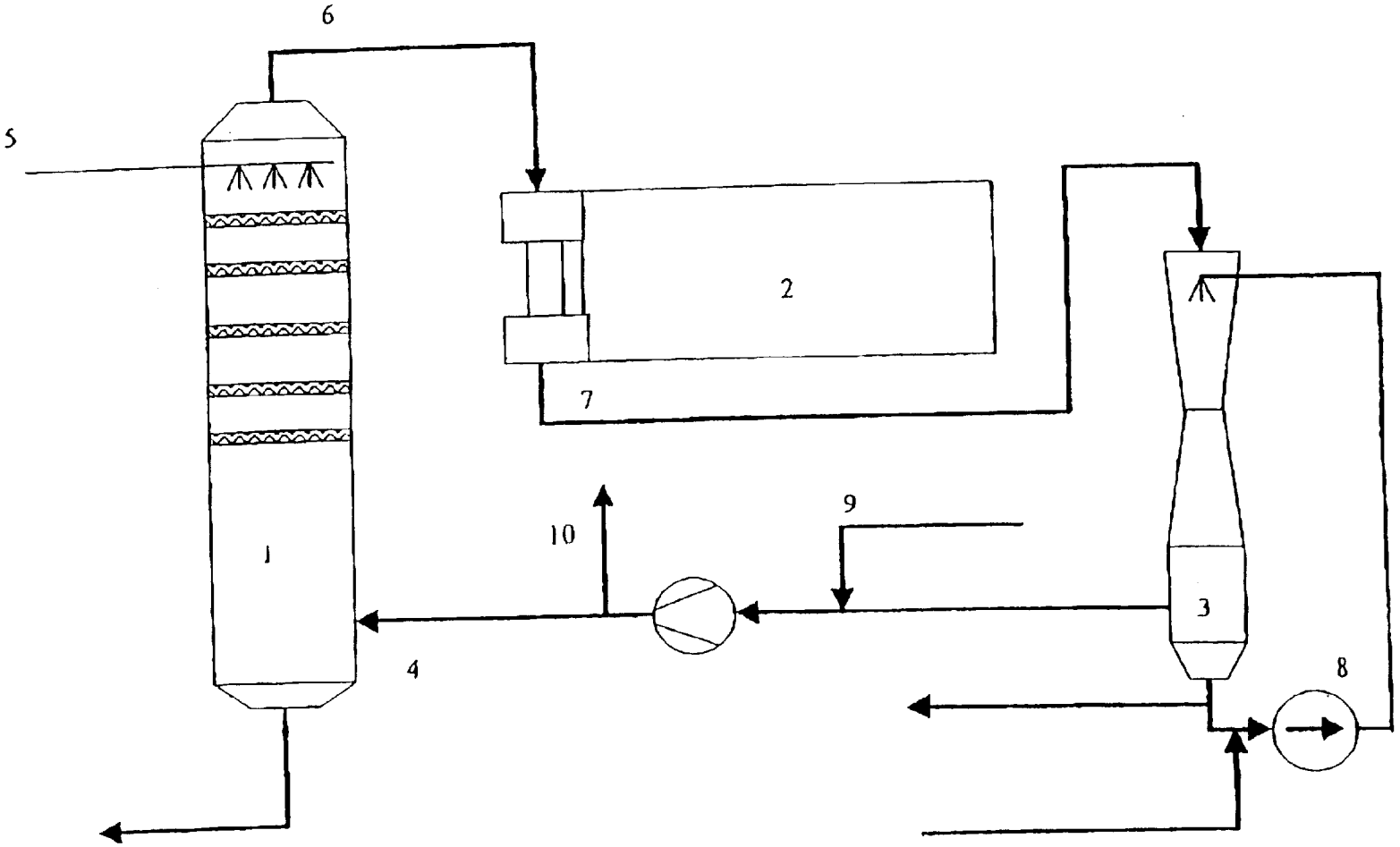

The invention will in the following text be exemplified with reference to a scheme show in the attached drawing.

In the present invention a gas is used as a medium for stripping off the sulphides from the condensate. This gas is substantially and preferably composed of air. This process step is normally designed as a scrubber column 1, where the gas 4 is introduced in the lower section and the condensate 5 in the upper section, thus that the gas and the condensate meet in counterflow contact. The contact means in the scrubber can be trays or packing material. The gas 6 leaving the scrubber will contain sulphides in form i.a of hydrogen sulphide and methyl mercaptan, but also organic compounds such as methanol and terpenes. This contaminated gas 6 is led to an oxidization process 2, where the gas is treated counterflow in a regenerative beat exchanger. The gas 7 from the oxidization step contains partly sulphur dioxide These gases are then fed to a contact device, in form of a $SO_2$ scrubber 3, where the sulphur dioxide is absorbed in a preferably alkaline solution 8. The gas is then returned to the condensate scrubber to be used again as a stripping medium. In this manner is formed a closed the loop. Since oxidation in the closed loop consumes oxygen is necessary to add fresh oxygen. Additional oxygen can be added by supply 9 preferably of air or some other oxygen containing gas. The system does not allow for gas accumulation in the loop and therefore a minor portion of the gas 10 must be bled off. The gas circulation through the three process steps is accomplished by the use preferably of a fan.

Since the gas in the closed loop is primarily being circulated, an elevated level of various gas components can accumulate to rather high levels. However, since only a minor portion of the gas is bled off, the discharge of components harmful to the environment, will be limited, in spite of high concentrations in the system.

A method of improving the cleaning of the condensate in the stripper is to increase the level of $SO_2$ after the $SO_2$ scrubber (3). Such a method will result in that the condensate in the stripper (1) will get a lower pH value. A lower pH value in turn gives a better stripping of sulphides and makes possible an almost complete stripping of sulphides. This would otherwise be difficult to achieve since the condensate contains a smaller amount of alkali components, i.e. ammonia, which would increase the pH value of the condensate when the acidic sulfides are stripped off. An alkali component such as ammonia will remain in the condensate at a lowered pH. Thereby is avoided discharge of ammonia, which should otherwise be transformed to Nox, after the oxidation process.

An increase of the $SO_2$ concentration after the $SO_2$ scrubber (3) can be obtained by adjusting the supply of alkali to this stage thus that the te absorption medium will get a comparatively lower pH. The lower the pH the higher the $SO_2$ concentration in the gas leaving the scrubber (3). The higher the $SO_2$-level in the gas, which constitutes the stripper media, the better the efficiency of stripping off sulfides from the condensate. In turn this effect can be utilized in such a way that the ratio between the condensate flow and stripper gas flow can be increased with continuos good sulphide stripping. This in turn implies an elevated level of sulphides in the stripper off gases, which in turn means an increased $SO_2$ level after the oxidization step. In this way the $SO_2$ level in the entire system can be significantly increased. This gives the following benefits the $SO_2$ concentration after the $SO_2$ scrubber can be:

1. Production of a sodiumbisulfite solution with a relative low pH is made possible.
2. The size of the plant can be reduced
3. $NO_x$ emission is reduced (see above)

The first benefit is accomplished since an increased $SO_2$ level in a gas, from an equilibrium point of view, gives a lower pH in the absorption medium. Since the addition of alkali is reduced a bisulfite solution is formed. This acid can be utilized as acidification in e.g. the bleach plant or the tall oil plant. An increased $SO_2$-level in the recirculated gas results however in an increased $SO_2$ discharge from the system via the bleed off to the atmosphere (10). Connecting a scrubber in this point, to absorb SO2 can cure this. A scrubber in this position is preferably designed with multiple absorption steps, e.g. of the same design as the stripper. It could be so that only $SO_2$ is permitted to be absorbed in this position. In that way the $SO_2$ scrubber (3) can be eliminated from the system.

The second benefit follows the fact that the circulating gas volume substantially determines the size of the equipment Since an increased $SO_2$ content facilitates a higher ratio of condensate/stripper gas flow, the gas flow in the system can be reduced.

The cleaned condensate will contain very low levels of sulphides and also any terpenes will be stripped off. This will give a condensate which is rather free from nasty-smelling contaminants. Methanol is another significant contaminant in black liquor condensate.

Some of the methanol will be stripped off in the stripper and some will stay in the condensate. The amount stripped off methanol is dependent on the ratio of supplied condensate to gas and the volume of the circulated gas.

The heat economy in the system is excellent since no external heat energy must be added. In the oxidation stage, heat is furthermore generated. This energy can compensate for various energy losses in the system, and any surplus can be absorbed as heat in the outgoing condensate. In other systems, where for example air is used as stripper gas, a significant amount of heat is absorbed in the air since the warm condensate transfers water vapor in contact with air. This cools down the condensate, which is avoided in the present invention, where any possible evaporated water vapor is returned to the system. It might also be possible to recover heat from the system by implementing a heat exchanger in the system. With such a heat exchanger, which cools the system, the temperature can be controlled.

There might also be a need to supply heat to the system. One reason could be to avoid oversaturated gas in certain parts of the system. As the recirculated gas, for instance after the stripper, is saturated with water vapor there is a risk that water droplets will fall out as moisture in the gas. By heating the gas, it would be possible to eliminate that moisture.

The investment costs and the size of equipment is mainly directly proportional to the amount of recirculated gas. For that reason it is important to minimize the gas recirculation. This will consequently have an impact on the methanol removal. It is therefore reasonable to count with a certain amount of methanol still remaining in the condensate. Methanol, as a pollutant in the condensate can be a drawback if the condensate is discharged to the recipient. If the condensate is being recirculated back into the process, e.g. as process water in the bleach plant, brown stock washing or limewashing, then the condensate is excellent in spite of the methanol content.

Methanol has a positive impact on bleaching, it acts as a radical scavenger and it also increases the solubility of lignin. Furthermore, this condensate is metal free. Normal process water prepared from nearby water streams always contains a certain amount of metals, such as i.a. transition metals. These transition metals can be very harmful for the bleaching process since they decompose the bleaching agents such as hydrogen peroxide. Since the methanol act as a radical scavenger, the degradation of cellulose molecules will decrease. A metal free condensate used in the bleach plant therefore has significant benefits in spite of a certain methanol content. By recirculating the condensate to the process a discharge of oxygen consuming matters is avoided. The methanol enrichment in the process is very marginal, since the discharge of methanol from the process is relatively large for each process cycle.

The stripping of condensate can be performed in several different ways. The type of equipment chosen shall be an equipment having a very high stripper efficiency. Such type of equipment ought to have several equilibrium steps, where the condensate meets a counterflow of gas. Examples on such equipment are columns with trays or packing material. This is well defined in the technical literature, such as i.e. "Perry's Chemical Engineers' Handbook", MacGraw-Hill Book Company, 1984.

The oxidization process can be done in different ways, but the relatively low concentrations of combustible components require certain prerequisites for this type of process. A relatively high temperature is needed in order to oxidize the combustible components. A regenerative thermal oxidization process (RTO) is preferred where the gas is treated in a heat exchanger under such temperature conditions that almost a complete oxidization takes place. Example on such a process is described in the patent application PCT/SE85/00257.

Scrubbing of the $SO_2$ gas can be done with an alkaline solution At a pulp mill there is a surplus of alkaline process fluids. One such fluid is oxidized white liquor. In the oxidized white liquor the sulfides have been removed by oxidization. White liquor is such a strong alkali that $SO_2$ easily can be absorbed. One equilibrium stage is sufficient. A venturi scrubber is a piece of equipment wherein one equilibrium stage is almost achieved. A relatively high gas velocity can be maintained in a venturi scrubber, which makes it compact. The scrubber medium is circulated through the venturi.

The pH of the scrubber medium shall be controlled in order to control the $SO_2$ level in the gases leaving the scrubber. The venturi scrubber has also a significant benefit in that the circulating liquid can have a relatively short residence time. This implies a fast control of the pH in the scrubber. As the scrubber has only almost one equilibrium stage instead of several, a rapid response time is also achieved.

What is claimed is:

1. A method of removing sulphides and other volatile contaminants from liquor vapor condensate from a pulp manufacturing process, comprising, feeding said liquor vapor condensate from a pulp manufacturing process into a stripper (1), which is part of a closed loop comprising said stripper (1) a regenerative thermal oxidizer process (RTO) (2) and an $SO_2$ scrubber (3), in which loop a gas (4), comprising air and components formed or stripped off in the loop, are circulated, and where the circulating gas is used to strip off sulphides and other volatile components from the liquor vapor condensate from a pulp manufacturing process (5), whereafter the gas stream (6) exiting said stripper (1) is fed into said RTO-process (2), where the stripped off components are combusted forming an $SO_2$ enriched gas, and thereafter feeding the $SO_2$ enriched gas (7) to the $SO_2$ scrubber (3), whereafter the circulating gas is returned to the stripper (1).

2. A method as claimed in claim 1, wherein the $SO_2$ scrubber (3) is part of the closed loop.

3. A method as claimed in claim 1 or 2, further comprising bleeding off from said loop a portion of the gas (10) in said loop, at the same time air or oxygen containing gas (9) is supplied to said loop.

4. A method as claimed in claim 3, wherein the gas (10) being bled off from the system is minimized by adding pure oxygen or an oxygen enriched air mixture to said loop, necessary as make up gas (9) for said oxidation.

5. A method as claimed in claim 3, further comprising scrubbing said bled off gas (10) with regard to $SO_2$ in a separate scrubber.

6. A method as claimed in claim 1, wherein alkali (8) is used as an absorption medium in said $SO_2$ scrubber.

7. A method as claimed in claim 6, wherein aid absorption medium is oxidized white liquor.

8. A method as claimed in claim 1 wherein the degree of acidification in the $SO_2$ scrubber (3) is controlled to ensure sufficient amount of $SO_2$ remaining in the gas (4) when it is returned to the stripper (1), where $SO_2$ acidifies the condensate (5) and thereby contributes to enhance the stripping off of sulphides from the condensate.

9. A method as claimed in claim 1, wherein a heat exchanger is installed in the closed loop, to recover or supply energy and thereby to control the temperature in the system.

10. A method as claimed in claim 1, wherein the amount of recirculated gas versus the amount of condensate is controlled for the purpose of optimizing the methanol content in the condensate.

* * * * *